United States Patent [19]

Kuskowski

[11] 4,134,627

[45] Jan. 16, 1979

[54] FOAM IN PLACE BREAKER STRIPS

[75] Inventor: Walter T. Kuskowski, Montreal, Canada

[73] Assignee: Canadian General Electric Company, Ltd., Toronto, Canada

[21] Appl. No.: 840,439

[22] Filed: Oct. 7, 1977

[30] Foreign Application Priority Data

Oct. 28, 1976 [CA] Canada ..... 246930

[51] Int. Cl.[2] ..... B65D 25/18

[52] U.S. Cl. ..... 312/214; 312/236; 312/296

[58] Field of Search ..... 312/214, 236, 296; 220/9 G, 9 R

[56] References Cited

U.S. PATENT DOCUMENTS

| | | | |
|---|---|---|---|
| 2,679,944 | 6/1954 | Morton | 220/9 G |
| 2,708,529 | 5/1955 | Lander et al. | 220/9 G |
| 2,873,041 | 2/1959 | Allen | 220/9 G |
| 3,078,003 | 2/1963 | Kesling | 312/214 |
| 3,270,907 | 9/1966 | Swaneck, Jr. | 220/9 G |
| 3,380,615 | 4/1968 | Kessler | 312/214 |
| 3,405,986 | 10/1968 | Cannon | 312/214 |
| 3,489,477 | 1/1970 | Harder, Jr. | 312/214 |
| 3,633,783 | 11/1972 | Aue | 220/9 G |
| 3,768,687 | 10/1973 | Spencer | 220/9 G |
| 4,056,211 | 11/1977 | Zumwalt | 220/9 G |

FOREIGN PATENT DOCUMENTS

| | | | |
|---|---|---|---|
| 683739 | 12/1952 | United Kingdom | 312/214 |

*Primary Examiner*—Victor N. Sakran
*Attorney, Agent, or Firm*—Frederick P. Weidner

[57] ABSTRACT

An improved breaker strip for a domestic refrigerating appliance which may be fitted in place prior to the appliance being insulated by an in situ foaming process to prevent foam leakage. First and second mechanical sealing means of a conventional type are provided to seal along the edges of the breaker strip to the appliance walls. An additional flange seal is further provided for each of the first and second sealing means so as to enshroud each means and form a small chamber therebetween and the respective flange seal. Reactive liquid which leaks into the chambers tends to expand to block them prior to any escape of such liquid past the conventional seals, and also to bias the conventional seals into greater sealing contact with the appliance walls.

6 Claims, 3 Drawing Figures

FIG. 1
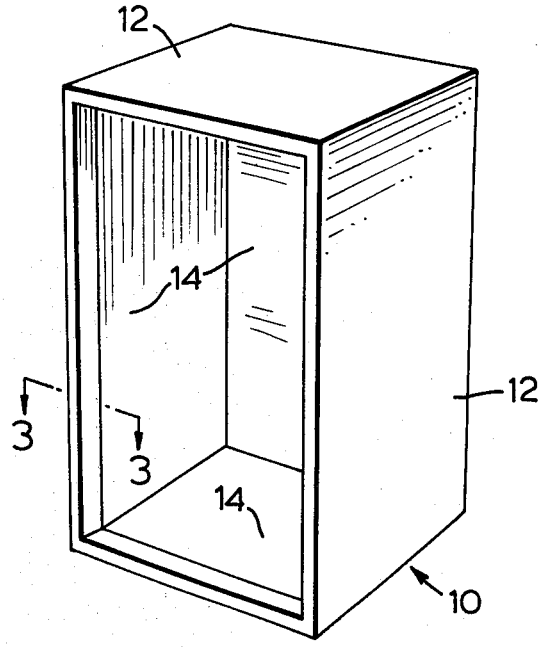
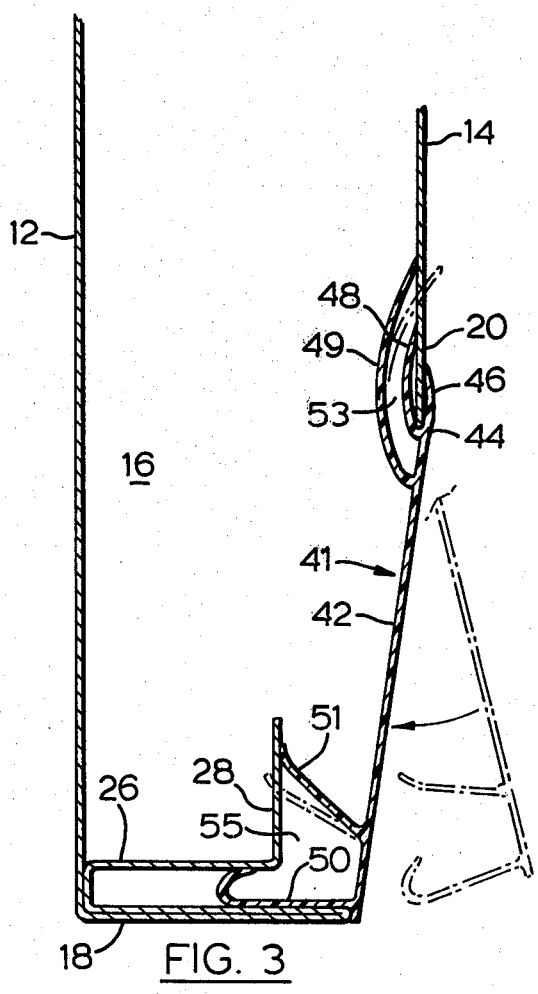
FIG. 3
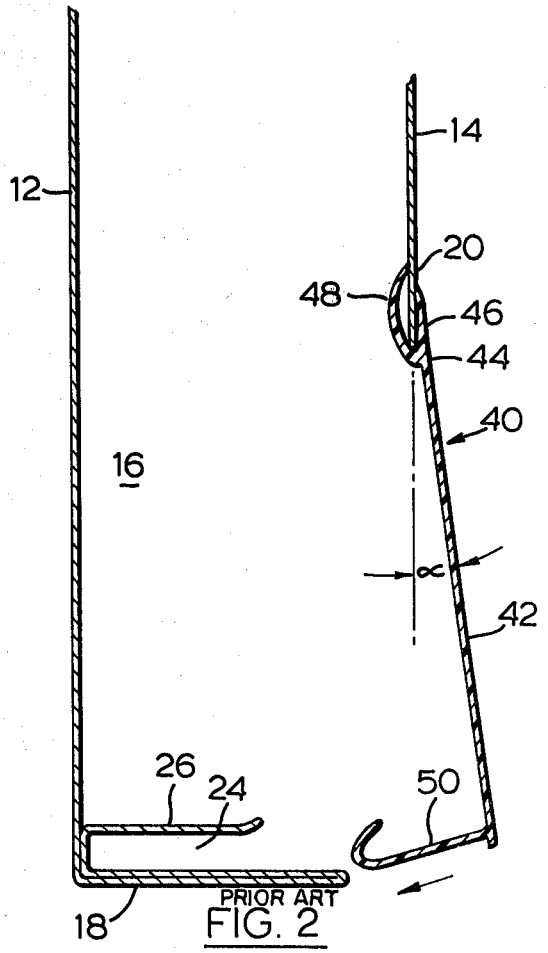
PRIOR ART
FIG. 2

FOAM IN PLACE BREAKER STRIPS

This invention relates to refrigerating appliances generally of a domestic type. It particularly relates to such appliances wherein an insulating foam is expanded within cavity walls of the appliance. Still more particularly it relates to improvements in the thermal breaker strips that join the cavity walls whereby the breaker strips may be employed effectively to retain the foam during the insulating process.

In appliances of the above type two related methods are commonly employed for the in situ type of foam insulation of the cavity walls. In both methods a reactant system is compounded; in the one method the system is allowed to react partially external to the cavity, and prior to set up the relatively viscous mixture is injected into the cavity. In the second method the liquid reactants are merely poured through one or more openings in the back of the cabinet; the mobile liquid runs down the inner surfaces of the cavity walls and tends to expand from the bottom of the cavity upwards. This second method is particularly testing of any imperfections in the wall structure, for the pressure generated as the foam expands tends to force the mobile liquid through only minute fissures. Unfortunately it is precisely in the area of the breaker strip joints where the liquid reactants tends to drain and accumulate, the cabinet during this foaming method being oriented with its open front downward. Initially temporary rubber gaskets were employed to seal in this area. However these required to be replaced frequently due to the adherence of foam to the gasket. Moreover the fitting and stripping of a temporary gasket was found to be time consuming. Latterly attempts have been made to use the breaker strips themselves either as a primary sealant means so as to contain the foam, or as a secondary sealant means in conjunction with, for example, fibre glass batts located within the cavity immediately to the rear of the breaker strip. However the reject rate in these methods due to foam escape marring the external surfaces of the appliance is relatively high, and it is usually necessary to provide a temporary tape seal between the edges of the breaker strip and the appliance walls.

It is a primary object of this invention to provide in an appliance of the aforesaid type a breaker strip which can be successfully employed to contain the insulating foam even when the more exigent second foaming method is employed.

In one aspect of my invention this object is attained by providing an improved breaker strip of a resilient, thermoplastic material, the breaker strip including a cheliform seal and a wedging seal situated along opposed edges of the strip, the cheliform seal engaging the edge of the liner wall and the wedging seal being received in a channel situated within the cavity. The breaker strip further includes first and second sealing flanges, respectively associated with the cheliform seal and the wedging seal, when fitted the flanges being resiliently biased against wall portions situated with the cavity so as to enclose therewith small chambers respectively enshrouding the cheliform seal and the wedging seal. Any liquid which leaks into the first of the chambers will be contained by the inner surface of the flange; as the liquid expands it will exert considerable pressure upon the cheliform seal to bias it into strongly sealing relationship with the inner surfacer of the liner wall, essentially precluding the possibility of leakage past the cheliform seal.

Any liquid which leaks into the second of the chambers will tend to foam so as to fill the chamber and preclude the access of liquid to the wedging seal. Additionally, in a preferred aspect of the invention, the second flange will be strongly biased into sealing relationship with an inside wallportion of the encasement due to the pressure created by the expanding foam prior to any tendency of liquid to contact the seal of the flange.

My invention is further described in relation to a preferred, practical embodiment thereof which is illustrated and compared to the prior art in the accompanying drawings wherein FIG. 1 shows a refrigerator cabinet assembly;

FIG. 2 shows a view along section 1 in 3—3 of FIG. 1, illustrative of prior art practise;

FIG. 3 is similar to FIG. 2 but shows the breaker strip therein modified accordance with my invention.

Referring to FIGS. 1 and 2 in detail, a refrigerating appliance which is represented generally by the numeral 10 comprises an encasement wall structure 12 and a liner wall structure 14 nesting therein and spaced therefrom by a cavity 16. The two wall structures are preferably folded from steel metal; in order to thermally insulate the liner, cavity 16 is normally filled with an insulating material. Additionally the forward edge 20 of liner 14 connects to encasement 12 by a thermal breaker strip 40, this generally being formed from a thermoplastic material such as polystyrene, ABS etc.

In one commonly employed process for insulating space 16, the structure of FIG. 1 is placed face downwards upon a male mould so as to support liner 14, and a reactive liquid composition is metred into one or more openings in the back of encasement 12. The liquid runs down the inside surfaces of the encasement and liner 14, expanding rapidly and generating apprecible pressure. At least a portion of the reactants, whilst still in a mobile, liquid state, flows over the interior surface of breaker strip 40.

One form of breaker strip 40 that has been used in the prior art with moderate success in the above insulation foaming system is illustrated in FIG. 2. This breaker strip has a continuous cheliform seal 44 formed along one edge thereof, and a wedging seal 50 adjacent the opposed edge. Cheliform seal 44 comprises resiliently opposed strips 46 and 48, the former being relatively more stiff than the latter due to its somewhat greater thickness and lesser width. The mouth opening of cheliform seal 44 in its normal position of repose is less than the thickness of edge 20 of liner wall 14 which is received therein, so as to provide a slight gripping action upon the wall. Due to the concavity of strip 48 the gripping action tends to seal that strip along its lip to the inner surface of wall 14. This gripping and sealing action is supplemented as described below.

The encasement wall structure 12 includes a wall portion 26 situated with cavity 16 parallel to frontal wall portion 18, the two wall portions defining a channel 24 therebetween. Wedging seal 50 is continuous along the second edge of breaker strip 40 and has a J shape in cross section. The mouth opening of cheliform seal 44 is arranged such that when the edge of wall 14 is initially engaged in the cheliform seal, the web 42 of the breaker strip is inclined at an angle shown in FIG. 2 as $\alpha$ of some 10° from the projected continuum of wall 14. In order to engage wedging seal 50 in channel 24, the breaker strip 40 is urged in the direction of the arrow.

Web 42 tends to pivot on the crotch of cheliform seal 44 about the edge of wall 14, and describes an angle α and additionally a further angle equivalent to the door draft allowance, usually of about 5 to 10°. The combined angle may be seen in FIG. 3 wherein the initial position of fitting (broken outline) and final fitting position are both shown. Thus as wedging seal 50 enters into wedging and sealing relationship with channel 24, strip 48 counter-rotates so as to be further biased against the interior surface of wall 14.

The ends of the channel 24 which, as normally formed are open, are filled with a mastic composition prior to fitting the breaker strip 40 into position to bridge between the encasement and liner wall structures. Where the breaker strips abut in the corners a temporary tape seal may be applied. When this ensemble is foam insulated by the above described process, a significant proportion of rejects are obtained due to slight foam leakage onto the exterior of the wall surfaces due to imperfections in the seal between the breaker strip and the wall structures 12 and 14.

A breaker strip 41 constructed according to my invention is shown in FIG. 3, comprises each element of the breaker strip 40 of the prior art shown in FIG. 2, and additionally a pair of sealing flanges 49, 51 respectively associated with cheliform section 44 and wedging seal 50. Sealing flange 49 is continuous along the first edge of breaker strip 41 so as to be generally parallel to strip 48 but spaced outwardly therefrom by about 3 mm. In its natural position of repose the lip of flange 49 hoods strip 46, as shown by its dotted outlined in FIG. 3. Thus when the edge 20 of wall 14 is engaged in cheliform seal 44, both flange 49 and strip 48 have their lip portions biased into engagement with the inner surface of liner 14 by small, resilient biasing forces. These biasing forces are supplemented in the previously described manner as the second edge of the breaker strip is wedged into position. In effect, flange 49, together with the portion of wall 14 intermediate that flange and strip 48, encloses a small chamber 53 shrouding the cheliform seal 44. When breaker strip 41 is employed to bridge between the encasement and liner wall structures and the resulting ensemble is foam insulated as described, some liquid foam producing reactants may leak past the seal formed by the lip of flange 49 into chamber 53. However, as the liquid in chamber 53 expands it will be contained by flange 49 and bear upon strip 48 so as to supplement the resilient biasing force thereon, thereby reducing the possibility of seepage past the seal provided by that strip. Also, chamber 53 will rapidly block with setting foam, thus precluding the further flow of liquid into the chamber.

Sealing flange 51 which is associated with wedging seal 50 locates outwardly from the wedging seal, and is angulated upwardly from web 42 at an angle of about 55° although this angle may vary widely. Channel wall 26 is overturned at 28; the width of flange 51 is such that the flange engages wall portion 28 and is forced upwardly from its position of repose, shown in dotted outline in FIG. 3, and biased into sealing relationship with that wall portion as wedging seal 50 is forced into channel 24. This biasing force will be supplemented when cavity 16 is foam insulated with liquid foam producing reactants, for at least part of the liquid will collect and expand in the gutter created at the root of flange 51 and web 42, thereby forcing flange 51 away from the web, and into contact with wall portion 28. In effect, flange 51, together with contiguous portions of wall 28 and web 42, encloses a small chamber 55 which enshrouds wedging seal 50. Should there be any seepage of liquid foam producing reactants past the seal created flange 51, this will tend to expand so as to block chamber 55 before any liquid will pass wedging seal 50. In practise, the incidence of rejects due to the escape of foam when using the breaker strip 41 of my invention is extremely low, and may normally be ascribed to gross deformities in the metal wall structures 12 or 14 in the region of the breaker strip seals.

The embodiments of the invention in which an exclusive property or privilege is claimed are defined as follows:

1. In a refrigerating appliance comprising an encasement wall structure, a liner structure nesting within said encasement with a cavity therebetween, a foam insulating material expanded within said cavity, adjacent forwardly located edge portions of said wall structures being connected by a thermal breaker strip of resilient plastic material, said breaker strip including a cheliform seal adjacent a first edge thereof, and a wedging seal adjacent a second edge thereof opposed to said first edge, said encasement wall structure including a channel means for receiving said wedging seal in wedging and sealing relationship, the improvement wherein said breaker strip includes first and second sealing flanges respectively associated with said cheliform seal and said wedging seal and located outwardly therefrom, each said flange being resiliently biased into sealing relationship against the inside wall surface portions within said cavity to enclose therewith a small chamber respectively enshrouding said cheliform seal and said wedging seal.

2. The refrigerating appliance of claim 1 wherein each said cheliform seal, said wedging seal and said first and second sealing flanges are coextensive with the length of said breaker strip.

3. The refrigerating appliance of claim 1 wherein said first flange is concave in section, and generally parallel to the inner member of said cheliform seal.

4. The refrigerating appliance of claim 1 wherein said second flange diverges from the web of said breaker strip at an angle of about 55°.

5. The refrigerating appliance of claim 3 wherein a biasing force is generated as said wedging seal is engaged in said channel so as to urge at least said first seal into sealing relationship with a wall position within said cavity.

6. The refrigerating appliance of claim 4 wherein a biasing force is generated as said wedging seal is engaged in said channel so as to urge at least said second seal into sealing relationship with a wall portion within said cavity.

* * * * *

UNITED STATES PATENT AND TRADEMARK OFFICE

CERTIFICATE OF CORRECTION

PATENT NO. : 4,134,627
DATED : January 16, 1979
INVENTOR(S) : Walter T. Kuskowski It is certified that error appears in the above-identified patent and that said Letters Patent are hereby corrected as shown below:

Column 4, Line 2, Claim 1, after the word liner, please insert the word "wall."

Signed and Sealed this

*Eighth* Day of *May 1979*

[SEAL]

*Attest:*

RUTH C. MASON
*Attesting Officer*

DONALD W. BANNER
*Commissioner of Patents and Trademarks*